US008112914B2

(12) United States Patent
Miller et al.

(10) Patent No.: US 8,112,914 B2
(45) Date of Patent: Feb. 14, 2012

(54) FULLY AUTOMATIC COUPLER FOR EXCAVATOR ARM

(75) Inventors: Gary Miller, Tyne & Wear (GB); Howard Reay, Tyne & Wear (GB)

(73) Assignee: Miller International, Ltd., Casemates Square (GI)

( * ) Notice: Subject to any disclaimer, the term of this patent is extended or adjusted under 35 U.S.C. 154(b) by 0 days.

(21) Appl. No.: 12/698,700

(22) Filed: Feb. 2, 2010

(65) Prior Publication Data

US 2010/0192425 A1 Aug. 5, 2010

(30) Foreign Application Priority Data

Feb. 3, 2009 (GB) ..... 0901729.4
Mar. 5, 2009 (GB) ..... 0903842.3

(51) Int. Cl.
*E02F 3/96* (2006.01)

(52) U.S. Cl. ..... 37/468; 172/272

(58) Field of Classification Search ..... 37/403–410, 37/468; 172/272–274; 414/705, 723, 724; 403/231, 322.1, 325, 328, 330, 321
See application file for complete search history.

(56) References Cited

U.S. PATENT DOCUMENTS

| | | | | |
|---|---|---|---|---|
| D440,983 | S | 4/2001 | Miller et al. | |
| 6,233,852 | B1 * | 5/2001 | Pemberton | 37/468 |
| 6,422,805 | B1 | 7/2002 | Miller | |
| 6,481,124 | B1 | 11/2002 | Miller et al. | |
| 6,487,800 | B1 * | 12/2002 | Evans et al. | 37/468 |
| 6,625,909 | B1 | 9/2003 | Miller et al. | |
| 6,922,926 | B2 | 8/2005 | Miller et al. | |
| D565,062 | S | 3/2008 | Miller et al. | |
| 7,648,305 | B2 * | 1/2010 | Beales | 403/322.1 |
| 7,832,130 | B2 * | 11/2010 | Sederberg et al. | 37/468 |
| 2003/0154636 | A1 | 8/2003 | Miller et al. | |
| 2005/0169703 | A1 | 8/2005 | Fatemi | |
| 2007/0157492 | A1 | 7/2007 | Miller et al. | |
| 2007/0199214 | A1 | 8/2007 | McCormick et al. | |

FOREIGN PATENT DOCUMENTS

| | | | |
|---|---|---|---|
| EP | 2119834 | A2 | 11/2009 |
| FR | 2914932 | A1 | 10/2008 |
| GB | 2330570 | A | 4/1999 |
| GB | 2332417 | A | 6/1999 |
| GB | 2446138 | A | 8/2008 |
| GB | 2450127 | A | 12/2008 |
| GB | 2450202 | A | 12/2008 |
| GB | 2450203 | A | 12/2009 |
| GB | 2467380 | A | 8/2010 |
| GB | 2467383 | A | 8/2010 |
| WO | 2008/029112 | A2 | 3/2008 |
| WO | 2008/031590 | A2 | 3/2008 |

* cited by examiner

*Primary Examiner* — Robert E Pezzuto
(74) *Attorney, Agent, or Firm* — Stephen B. Salai, Esq.; Brian B. Shaw, Esq.; Harter Secrest & Emery LLP

(57) ABSTRACT

A coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position, wherein the powered latch, in its non-latching position, can maintain both the blocking mechanism in its non blocking position and the other latch in its non-latching position, irrespective of the orientation of the coupler.

42 Claims, 11 Drawing Sheets

FULLY AUTOMATIC COUPLER FOR EXCAVATOR ARM

CROSS-REFERENCE TO RELATED APPLICATIONS

None.

STATEMENT REGARDING FEDERALLY SPONSORED RESEARCH OR DEVELOPMENT

None.

NAMES OF THE PARTIES TO A JOINT RESEARCH AGREEMENT

None.

REFERENCE TO A "SEQUENCE LISTING"

None.

BACKGROUND OF THE INVENTION

1. Field of the Invention

The present invention relates to a coupler for attaching an accessory, such as an excavator bucket, to an excavator arm on an excavator. In particular it relates to a fully automatic coupler for attachment, at its top half, to an excavator arm, and having, in its bottom half, two jaws and two latches for selectively securing, and releasing, two attachment pins of an accessory in, or from, the jaws of the coupler.

2. Description of Related Art

Many couplers for attaching accessories to excavator arms of an excavator have been developed. Many of those have been manual or semi-automatic, requiring one or more manual step to be carried out at the coupler in order to complete or commence the attachment or removal of an accessory onto or from the coupler. An increasing drive, however, is to provide fully automatic couplers which allow the full securement and release of an accessory to and from the coupler by the operator from within the cab of the excavator via controls provided in the cab.

With any coupler, it is possible to use them incorrectly. Therefore it is possible that an accessory might not be fully, and securely, fastened onto the coupler. Such situations can lead to dangers, not only for the operator, but also for bystanders. That is because such an incorrectly mounted accessory can potentially fall off the coupler if the error is not noted and corrected. It would be desirable, therefore, to develop a coupler which will reduce or eliminate the opportunities for an operator to make an error that could cause such dangerous situations to arise.

BRIEF SUMMARY OF THE INVENTION

According to the present invention there is provided a coupler having a top half for attaching to an end of an excavator arm of an excavator and a bottom half for attaching to an accessory; wherein:

the bottom half comprises:

a first jaw having an opening pointing generally towards the front end of the coupler and a second jaw having an opening pointing generally downwards with respect to the coupler;

a first latching mechanism associated with the first jaw; and a second latching mechanism associated with the second jaw, the second latching mechanism being powered for movement between an open position and a closed position, wherein the first latching mechanism has an arm extending therefrom and towards the second latching mechanism, whereby the second latching mechanism can hold the first latching mechanism in an open position when it is in its own open position; and the coupler further comprising:

a blocking mechanism that is independent of the first latching mechanism, and being for selectively blocking the second latching mechanism in its latching position, the blocking mechanism being operable between a blocking position and an unblocking position by a separate drive means, or by the influence of gravity, operation by the influence of gravity comprising attaining a blocking position when the top side of the coupler is pointing generally upwards and an unblocking position when the bottom side of the coupler is pointing generally upwards.

Preferably the arm's free end directly bears against the second latching mechanism when the second latching mechanism is holding the first latching mechanism in an open position.

Preferably the first latching mechanism comprises a finger or block that extends in a different direction to the arm, and which provides an at least partial blockage of the opening of the first jaw when the first latching mechanism is in a jaw-closing position.

Preferably the arm of the first latching mechanism extends down one side of the internal space of the coupler and the blocking mechanism comprises a member that extends down the other side of the internal space of the coupler. Preferably the member comprises a second arm. The two arms, or the first arm and the member, can have a similar maximum width.

Preferably a hydraulic ram powers the second latching mechanism.

A separate hydraulic ram might operate the blocking mechanism. It is preferred, however, that the blocking mechanism is gravity operated. This reduces the number of moving or serviceable parts in the coupler.

Preferably the hydraulic ram for the second latching mechanism is located down the centre of the internal space of the coupler.

Preferably the arm of the first latch and the member of the blocking mechanism extend either side of the hydraulic ram (or of whatever powering means is provided for the second latching mechanism), and are spaced therefrom.

Preferably the blocking mechanism shares a common pivotal axis to the hydraulic ram for the second latching mechanism. Preferably that or those axes are defined by a hinge pin that is mounted to the frame of the coupler. Preferably the hinge pin extends laterally with respect to the frame of the coupler, i.e. between sideplates of the coupler.

Preferably the first latching mechanism is defined by a first pivotal latch.

Preferably the second latching mechanism is defined by a second pivotal latch.

Preferably both the first pivotal latch and the second pivotal latch are mounted for pivotal movements relative to the frame of the coupler about hinge pins that are mounted to the frame. Preferably those hinge pins extend laterally with respect to the frame of the coupler.

Preferably the first latching mechanism includes a latching member defined by a finger or a block. Preferably the finger or block extends generally perpendicularly relative to the arm. Preferably it extends generally downwards. It is adapted, in use, to extend at least partially across the opening of the front jaw when the first latching member is in a jaw closing position.

Preferably the latching member has a greater width than the arm of the first latching mechanism. Preferably the width of the latching member is approximately, or at least, a third of the width of the front jaw. More preferably it is about, or more than, half the width of the front jaw.

The latching member is preferably painted in a high-visibility colour, such as red or yellow, or in a contrasting colour to the jaw. This is to make it more visible from the cab of the excavator, through the opening of the jaw, when the first latching mechanism is in a jaw closing position; it can function as a visual check for jaw engagement, even from the cab, since that jaw usually points towards the cab during the accessory engagement process.

Preferably the arm has a width of less than half the width of the latching member.

Preferably the free end of the arm has an increased lateral width relative to the rest of the arm to provide a greater mass at its free end. This is to facilitate the operation of the first latch when it is operable under the influence of gravity. Preferably the front latch is operable under the influence of gravity between the open position, when the coupler is inverted, and a jaw-closing position, when the coupler is arranged upright, or in a normal, in use, orientation, i.e. with its top portion generally uppermost. An arm powering mechanism might be provided, however, to remotely lift the arm, e.g. a further hydraulic ram. The use of gravity, however, is the preferred arrangement.

Preferably no mechanical biasing means whatsoever are provided for the first latching mechanism, i.e. for biasing it towards a closed position—gravity is used exclusively for causing the opening/closing of that latching mechanism. Mechanisms might, however, interfere with that operation—i.e. the second latching mechanism can hold it out of its jaw-closing position until that second latching mechanism releases it.

Preferably the blocking member has a width that generally corresponds to the width of either the arm or the free end of the arm. The width of the blocking member, however, is preferably less than the width of the latching member—perhaps half that width.

Preferably the second latching mechanism comprises a pivoting latching hook.

Preferably the rear surface of the latching hook (the surface facing away from the rear jaw of the hook) has steps provided thereon for providing adjustability for the blocking mechanism, whereby a plurality of different accessories, each with different pin spacings (i.e. the distance between the axes of the pair of pins), can be accommodated by the coupler.

For that same purpose, it is preferred that the opening of the downwardly facing jaw has a height—measured in the longitudinal direction of the coupler—of at least 1.5× the height—measured in the height direction of the coupler—of the opening of the front jaw. More preferably it is approximately twice that dimension.

Preferably the steps on the rear surface of the hook are down just one flank of that surface of the hook; the hook may have two such flanks, with the other flank being adapted for selectively engaging the first latching mechanism. For example, on that other flank, a different form can provided, such as a smooth back with a single flange, or a stepped surface, for engaging against the raised free end of the arm of the first latching mechanism, i.e. when the hook is in its open position.

Because of the presence of the blocking mechanism, that inter-engagement between the arm and the rear of the hook is only achievable upon moving the blocking mechanism into a non blocking mechanism—the hook is otherwise resisted from retraction towards its open position. Therefore, with the gravity operated embodiment, that is only possible upon inverting the coupler, so as both to release the blocking mechanism and to raise the arm, whereby upon drawing back the hook to its open position, the arm will be retained upon the back of the hook automatically.

The two flanks may be formed by providing the hook with a bifurcated backside. The hinge-pin for attaching the actuator for the hook to the hook may then bridge between the two flanks, the space between the two flanks providing room for the actuator to pivot relative to the hook.

Preferably the arm of the first latching mechanism has a cut-out in its underside for accommodating the structure of the front jaw and the attachment pin. Preferably that cut-out rests against the top of the structure of the front jaw when the first latching mechanism is in a jaw-closing position. That then provided a stop for defining a first extreme of movement for that arm.

Preferably the arm has an indentation in a top wall thereof for engaging a member of the frame of the coupler for defining a second extreme of movement for that arm. Preferably that member of the frame is a bearing portion of the frame, in the sidewall of the frame, for receiving a hinge pin of the actuator for the powered latching mechanism.

Extremes of movement for the blocking mechanism can be provided by elements or stops provided on the frame, or, in one respect, by an extended flange at the back of the hook, usually towards its bottom.

Preferably the latching member of the first latching mechanism has a face that is adapted to face towards an attachment pin of an accessory, when the accessory pin is located fully within the front jaw. Preferably that surface extends downwardly into the jaw at least one-third of the way across the opening. More preferably it extends at least halfway across the opening. By extending it sufficiently across the opening, and/or providing it with an appropriate shape, an attachment pin in the front jaw can usually be prevented from forcing the first latching mechanism from its jaw-closing position into its open position, even if the pin was to apply a considerable force against the latching member.

The resistance to opening of the first latching member can be enhanced further by correctly locating the hinge axis of the first latching member above the line of reaction force between the attachment pin and the pin facing/engaging surface of the latching member as will occur once the first latching member is in its jaw-closing position. With that arrangement, those reaction forces would tend to maintain the latching member in a closed position, rather than tending to open the jaw.

Preferably the pin-facing surface of the latching member is concavely curved.

Preferably the blocking mechanism is spring biased towards a blocking position by a spring member that is adapted to engage against a portion of the excavator arm during normal conditions of use, i.e. in non-crowd orientations. That spring member preferably extends into the top half of the coupler, towards the rear end of the coupler, but in front of the rear attachment hole in that top half. The spring member does not engage against any part of the frame of the coupler. When the coupler and excavator arm are moved into the crowd position, however, that spring arm is no longer engaging the portion of the excavator arm with sufficient bias to maintain the blocking mechanism in a blocking position.

Preferably the front jaw has a ridge or lip, or a dip or groove, provided in the upper wall of its profile, the ridge or lip extending downwardly, and the dip or groove, where instead or additionally provided, extending upwardly.

The ridge or lip is the preferred arrangement for the upper wall. In effect it extends partially across the opening of the jaw. Preferably it extends no more than a fifth of the way across the opening. Preferably it is between 5 and 8 mm high.

The lower wall of the front jaw may also, or alternatively, have a ridge or lip, or a dip or groove, provided in it, the ridge or lip extending upwardly, and the dip or groove, where instead or additionally provided, extending downwardly.

The dip or groove is the preferred arrangement for the lower wall. It may be radiused for partially accommodating an attachment pin, i.e. should an attachment pin be in the front jaw such that it is not secured into the rear of the front jaw. The radius need not match the radius of the attachment pin. In that regard, the radius of it nearest the opening is preferably of a smaller radius than the pin, whereby the groove provides an outer lip against which the attachment pin can hit, for stopping further exiting of the pin from the jaw, in the event of the attachment pin starting to slip out of the front jaw.

Preferably the dip or groove is between 5 and 8 mm deep.

Preferably the dip or groove's depth is between 0.3× and 0.1× the diametric height of the jaw.

The upper wall of the front jaw's profile may extend further forwards, relative to the frame of the coupler, than the lower wall of that profile so as to overhang the lower profile, The lip or ridge in the upper wall preferably is located in the overhanging area of that upper wall. Preferably it is overhanging, and clear, of the lower wall such that the gap between the bottom of the ridge or lip and the free end of the lower wall has a length no less than the distance between that lower wall and the upper wall when measured diametrically (or approximately perpendicularly) therebetween. The upper and lower walls, however, are not usually parallel to one another—a widening mouth facilitates attachment pin location into the jaw.

The present invention also provides an excavator with a powered excavator arm having a coupler on an end thereof, the coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position. The coupler may additionally have any of the above features from the first aspect of the invention, either in isolation or in combination with its potentially, but in practice not necessarily, dependent features.

The present invention also provided a method of coupling an accessory to a coupler as defined in the claims. For example, the method may comprise:

a) providing an excavator with a powered excavator arm having a coupler on an end thereof, the coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position;

b) opening the jaw with the powered latch;

b) providing an accessory with two attachment pins thereon sized and spaced to fit into the two jaws of the coupler;

c) powering the excavator arm to manipulate the coupler to locate a first attachment pin of the accessory into the jaw associated with the other latch;

d) powering the excavator arm to curl the coupler relative to the accessory to locate the second attachment pin into the opened jaw; and e) powering the powered latch to engage the powered latch against the second attachment pin to secure it within that now closed jaw.

Preferably the powered latch is powered in step b) while the coupler is at least partially inverted, preferably in the crowd position, the blocking mechanism and other latch being gravity operated such that they move to non blocking and open positions, respectively, as the coupler is moved into that at least partially inverted orientation. Alternatively one or both of those elements might be powered for movement into their non-blocking and open positions.

The present invention also provides a method of decoupling an accessory from the coupler as defined in the claims. For example, the method might comprise:

a) providing an excavator with a powered excavator arm having a coupler on an end thereof, the coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position;

b) providing an accessory with two attachment pins thereon fitted into the two jaws of the coupler;

c) rotating the coupler and accessory into a crowd position for at least partially inverting the coupler;

d) opening the jaw having the powered latch;

e) powering the excavator arm to manipulate the coupler back from its crowd position to position the accessory on hard standing, such as the ground; and continuing to power the excavator arm to guide the coupler off the accessory, the two latches now being open.

The present invention also provides a coupler having a top half for attaching to an end of an excavator arm of an excavator and a bottom half for attaching to an accessory; wherein:

the bottom half comprises:

a first jaw having an opening pointing generally towards the front end of the coupler and a second jaw having an opening pointing generally downwards with respect to the coupler;

a first latching mechanism associated with the first jaw; and a second latching mechanism associated with the second jaw, the second latching mechanism being powered for movement between an open position and a closed position;

wherein the first latching mechanism has an arm extending therefrom and towards the second latching mechanism, whereby the second latching mechanism can hold the first latching mechanism in an open position when it is in its own fully open position, and whereby while the first latching mechanism in a latching position for the first jaw, the second latching mechanism is blocked from moving from its latching position into its fully open position by the end of the arm.

The first latching mechanism can operate under the influence of gravity, just like the first latching mechanism of the other aspects of this invention. Indeed, the first latching mechanism can have many of the features of the first latching mechanism of the other aspects of this invention.

Preferably the second latching mechanism has a flange that extends towards the end of the arm while the second latching mechanism is in the latching position.

Preferably the first latching mechanism is provided with a spring arm that extends up therefrom into the top half of the coupler for selective engagement against the excavator arm.

Preferably the spring arm is J shaped.

DETAILED DESCRIPTION OF THE INVENTION

Figure 1:
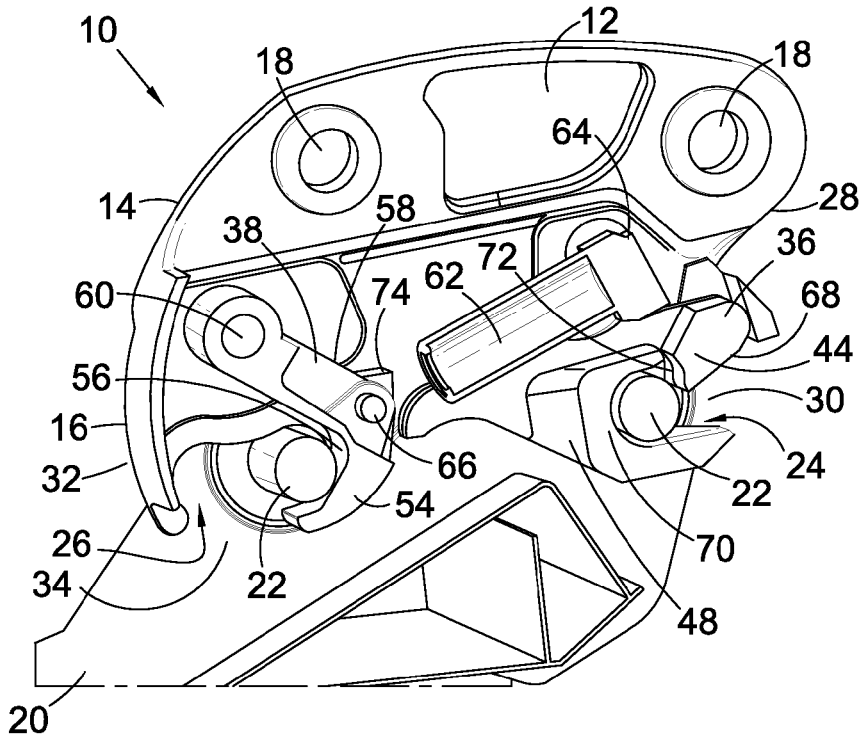
FIGS. 1 and 2 schematically show left and right, cut-away, partial, sections through a coupler of the present invention in a normal working condition.

Referring first of all to FIG. 1, there is shown a partial section through a coupler of the present invention. Various internal elements of the coupler have been simplified or removed for clarity. What is illustrated, however, is a coupler 10 comprising a frame 12 having a top half 14 and a bottom half 16.

Figure 2:
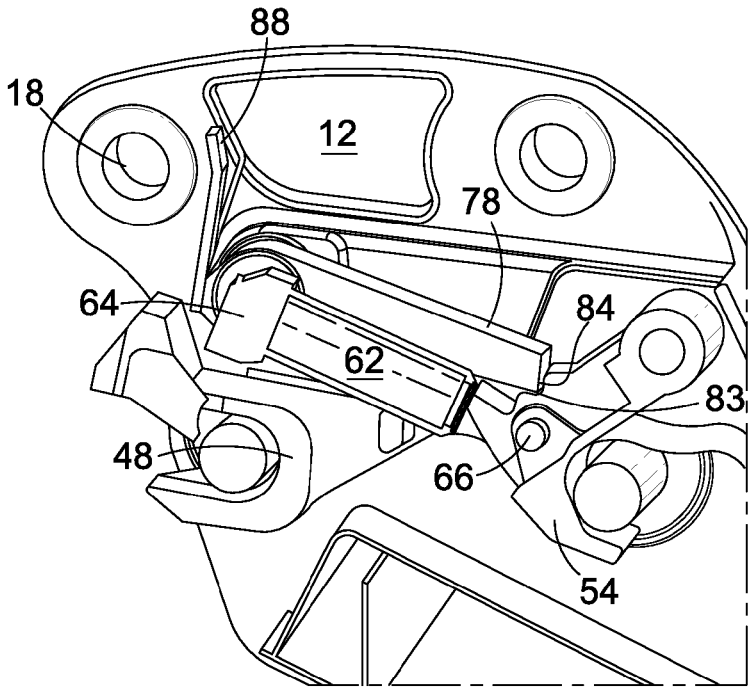

The opposite side of the coupler 10 is shown in FIG. 2. It likewise has parts cut away or removed for clarity.

The top half 14 has two pairs of attachment holes 18 in its sidewalls for connecting the coupler 10 to an end of an excavator arm of a excavator (not shown) via an a pair of attachment pins. Such an attachment is generally recognised as being conventional for excavator arms, and has been the conventional technique used for attaching accessories directly to the excavator arm. The present invention, however, positions a coupler 10 between the end of the excavator arm and the accessory 20.

In all of the Figures, only a part of an accessory 20 is shown. Such an accessory, however, might be, for example, a conventional digging bucket.

For this type of coupler 10, the accessory has a pair of attachment pins 22. The attachment pins 22 are arranged on the bucket in a parallel manner and are for engagement with two jaws 24, 26 that are provided in the bottom half 16 of the coupler 10.

A first one of the jaws is a front jaw 24. It is provided towards the front 28 of the coupler 10. That front jaw 24 has an opening 30 that faces generally forwards with respect to the longitudinal axis of the coupler 10.

The second jaw is a rear jaw 26. It is provided towards the rear 32 of the coupler 10. It also has an opening 34. That second opening 34, however, faces downwardly with respect to the coupler 10.

The front jaw 24, in use, is normally for engaging a first or front attachment pin 22 of the accessory 20, whereas the rear jaw 26 of the coupler 10 is usually for engaging the second or rear attachment pin 22 of the accessory 20. That occurs after the first attachment pin 22 has been engaged within the front jaw 24. A first step in an accessory attachment is therefore usually the engagement of an attachment pin 22 in a front jaw 24 of the coupler by an appropriate manipulation of the excavator arm. Then, the second attachment pin 22 needs to be engaged into the rear jaw 26 by rotating the rear 32 of the coupler 10 downwardly. For these steps to occur, however, any latching means for those jaws needs to be set appropriately for allowing the jaws to receive the pins. This aspect of the present invention will now be described in detail.

Both the front jaw 24 and the rear jaw 26 are provided with a latching mechanism. The first latching mechanism 36 is provided for the front jaw 24 and the second latching mechanism 38 is provided for the rear jaw 26. Parts of each latching mechanism 36, 38 are visible in each pair of drawings (FIGS. 1 & 2, FIGS. 3 & 4, and FIGS. 8 & 9), each pair showing opposing sides of the coupler in a corresponding coupler condition.

Figure 3:
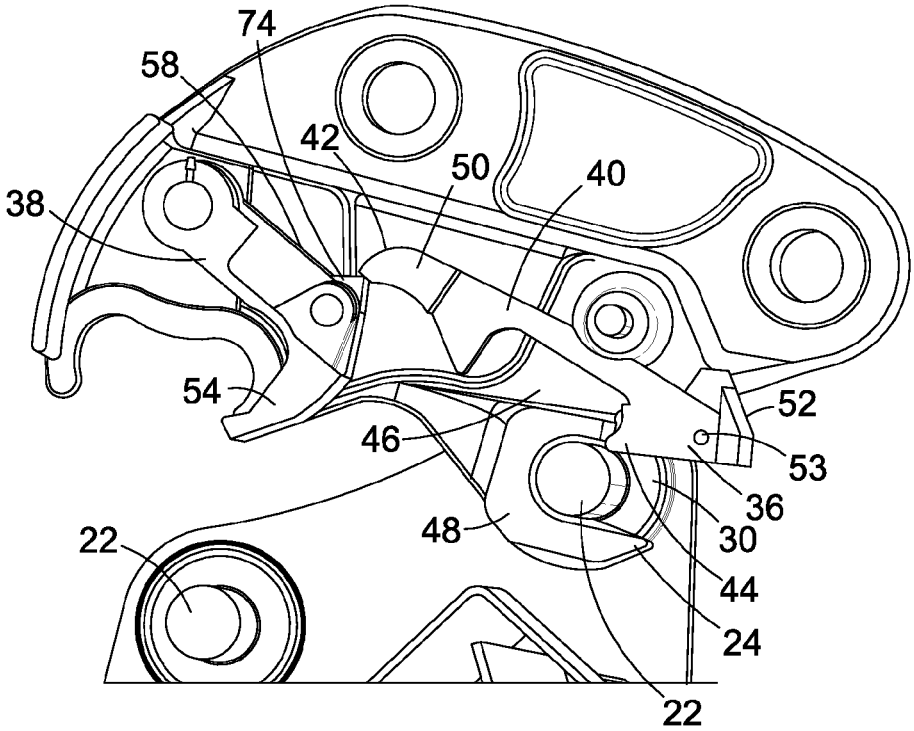
FIGS. 3 and 4 show similar views, but during a first pin engagement step (the hydraulic ram has been removed for clarity)

The first latching mechanism 36 is best illustrated perhaps in FIG. 3. Referring, therefore, to FIG. 3, the first latching mechanism 36 comprises an arm 40 with a free end 42. The first latching mechanism 36 further comprises a finger or block 44 that is adapted or shaped such that when the first latching mechanism 36 is in an open position, as shown in FIG. 3, the finger or block 44 will have ascended into a position in which it will not hinder the movement of an attachment pin 22 out of the opening 30 of the front jaw 24, but also such that when the first latching mechanism 36 is in a jaw-closing position, as shown in FIG. 1, the finger or block 44 will block movement of the attachment pin 22 out of that opening 30 of the front jaw 24.

That block 44 is preferably wedge shaped. However, it might alternatively be curved, while still performing the same function.

The arm 40 of the first latching mechanism 36 is also provided with a cut-out area 46 to provide a space for accommodating the structure 48 of the front jaw 24. As shown in the drawings, the structure 48 of the front jaw 24 is generally a solid lump of hardened steel, welded to the frame, although it might be integrally formed thereon. The piece might, for example, be formed as part of a solid casting.

Figure 8:
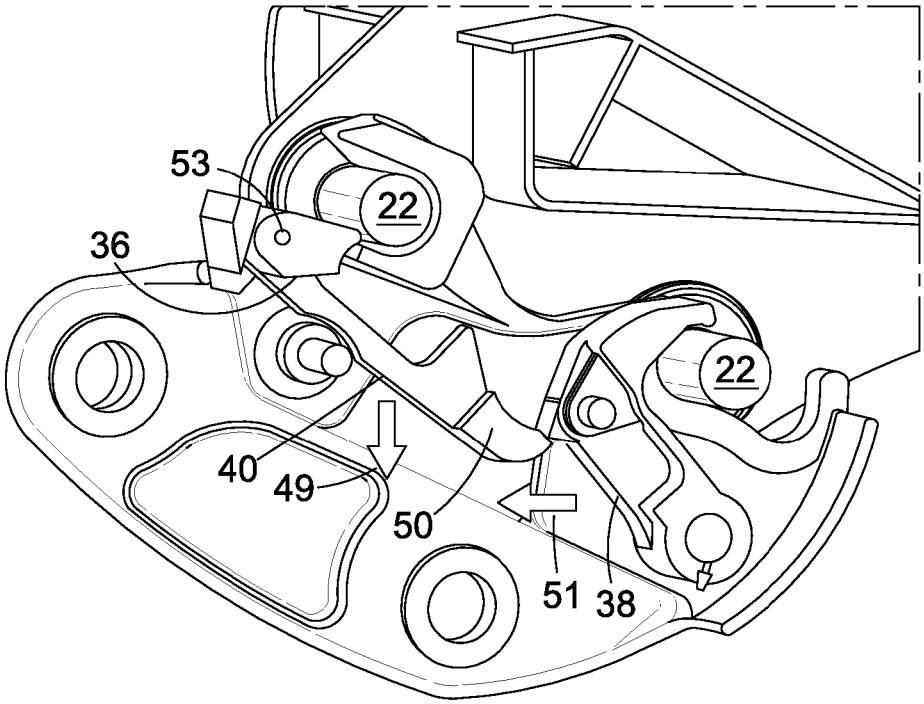
FIGS. 8 and 9 schematically illustrate, in similar views to the first seven Figures, opposing sections through the coupler, but while it is in an inverted condition, Le. during an accessory disconnection procedure.

At the free end 42 of the arm 40 there is provided a widened region 50. This widened region 50 provides a significant mass at the free end 42 of the arm 40. This helps to increase the reliability of the latching mechanism since the extra mass at the end will generate a better gravity induced moment on the arm 40 upon inverting the coupler, such as into the position shown in FIG. 8. FIG. 8 clearly shows that widened region 50, and also shows that the first latching mechanism 36 has fallen into an open position—see the arrow 49. Likewise, the blocking mechanism 78 shown in FIG. 9 will have fallen into a non-blocking position—see arrow 86, whereby the second latching mechanism 38 can be pulled back into an open position—see the arrows 51 in both FIGS. 8 and 9. However those additional features will be returned to later on.

Returning, therefore, to the first latching mechanism 36. It is rotatably mounted to the frame 12 of the coupler 10 about a pivot point 53. A housing 52 provided just in front of that pivot point 53 serves to protects the leading face of the first latching mechanism 36 when an attachment pin of an accessory is initially being aligned to the jaw—this equipment can be very heavy, and are assumed to be very tough, whereby they are often roughly treated by users in an attempt to force attachment pins into the jaws 24, 26. That housing 52 may be an integral part of the frame 12, or else it may be a separate part welded or otherwise fixed onto the frame 12 of the coupler 10.

In preferred embodiments, the frame 12 is a moulded component with some finishing work carried out for perfecting the locations of any attachment point or jaws or hinge points or other bearing surfaces. It might, alternatively, be fabricated from individual components and plates of steel.

Referring next to the second latching mechanism 38, as also shown in FIG. 1, that second latching mechanism 38 comprises a pivoting latching hook 54 with an attachment pin facing surface 56 and a bifurcated rear surface 58.

The hook is mounted within the frame of the coupler such that its rear surface 58 is arranged generally to face forwardly and/or upwardly with respect to the coupler 10. It can mostly face forwardly when the hook is in a fully closed position—i.e. displaced mostly rearwardly—not shown, and it faces mostly upwardly when the hook 54 is in an open position, as shown in FIG. 1.

The hook 54 is pivotally mounted to the frame 12 at a hinge point as defined by a hinge pin 60.

Although an actuator for powering the hook 54 is only shown schematically in these drawings, the powered movement of the pivoting latching hook 54 is governed in this embodiment by a hydraulic ram 62. Screwthread drives, and other known actuators, might alternatively be used. In this preferred hydraulic ram 62, however, the hydraulic ram 62 comprises a cylinder that has a head 64 that is pivotally mounted to the frame. It also has a rod component (not shown) that extends from the cylinder to the hook 54 for attachment thereto via a further hinge pin 66. That rod preferably has a free end that is recessed into the back of the hook for rotation thereat about the hinge pin 66.

The hydraulic ram 62 can therefore pivot relative to the frame 12 and the hook 54 as the rod extends in and out of the cylinder for opening and closing the rear jaw 26, respectively.

Figure 5:
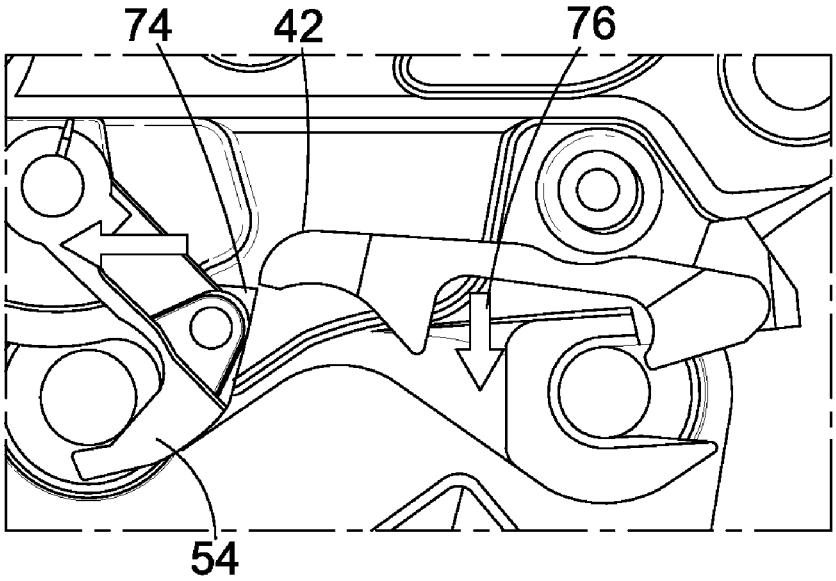
FIGS. 5 and 6 illustrate details of the first latching mechanism as it moves into its jaw-closing position.
Figure 6:
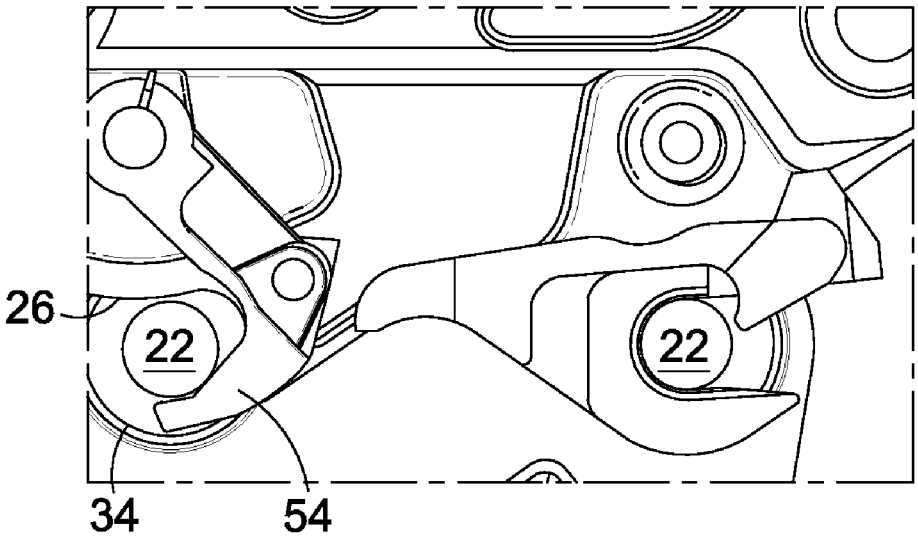
Figure 10:
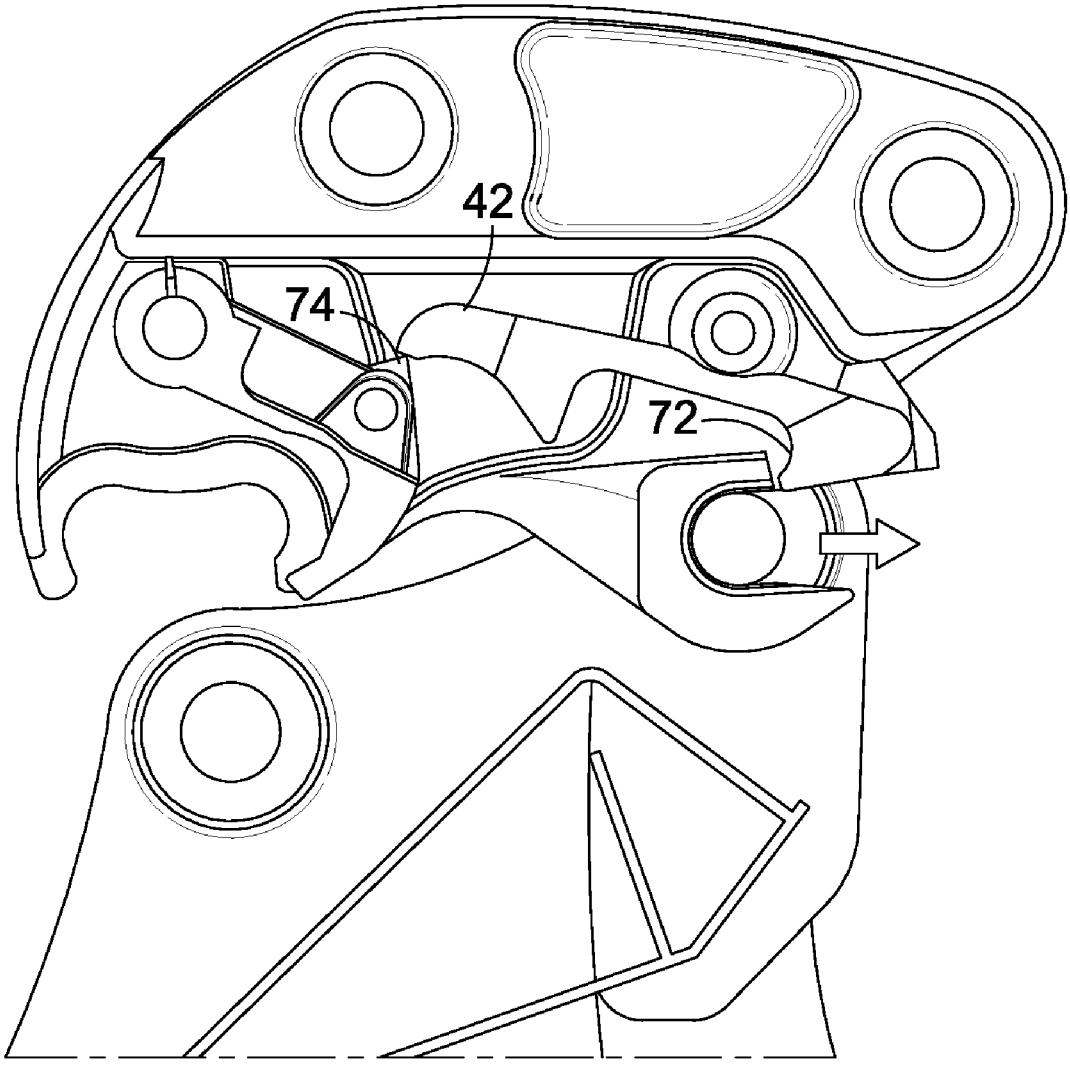
FIG. 10 shows the final step of that accessory removal procedure with the first latching mechanism being held up in its open position by the second latching mechanism.

Returning now to the method of attachment of an accessory to the coupler, as started to be described above, that commences by first inserting the first attachment pin 22 into the front jaw 24. However, that can only occur while the first latching mechanism is either held in a lifted position, as in FIG. 10, or while the first latching mechanism is in a condition where it is free to lift into such a lifted position upon engagement by the pin as the pin enters that front jaw. That condition is achieved when the hook 54 is in a rear jaw closing position, as in FIGS. 1, 6 and 7. That is because when the hook is in a more open position than that of FIG. 6 (e.g. as in FIG. 5), the free end 42 of the arm 40 will foul against the underside of the flange 74 on the rear surface 58 of the hook. That in turn would prevent the first latching mechanism from allowing a pin to be inserted into the front jaw 24. Therefore, before commencing an attachment procedure, an attachment receiving condition for the coupler must be achieved.

A first possible attachment receiving condition is arrived at by fully closing the rear jaw 26 with the hook 54 by fully powering out the hydraulic ram. Then, to mount an accessory to the coupler 10, the excavator arm is used to manipulate the coupler so as to align an attachment pin 22 with the front jaw for inserting the pin 22 into that front jaw 24. That insertion will impart a bearing force against the leading surface 68 of the block 44, whereupon, due to the pivotal arrangement of the first latching mechanism 36 with respect to the frame 12, the finger or block 44 will be lifted for opening the opening 30 of the front jaw 24, whereby the attachment pin 22 can become located within the front jaw 24 towards its rear surface 70.

For good positive location of that pin in the jaw 24, that rear surface 70 may be hemi-cylindrical, or it may be dual radiused, i.e. having a shape adapted to accommodate two differently radiused attachment pin sizes. These shapes are known in the art for conventional front jaws.

Figure 9:
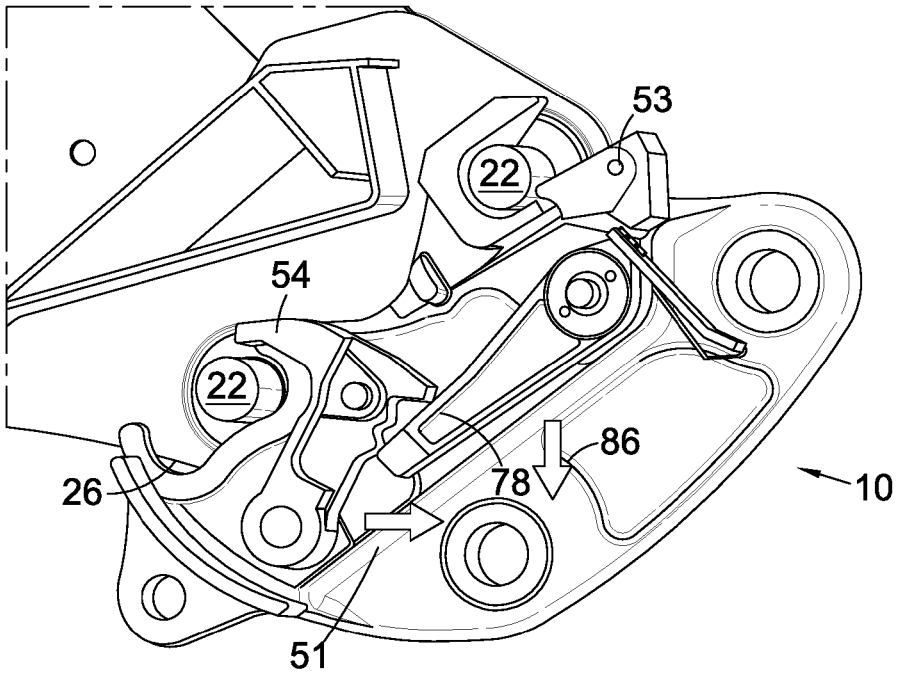

The above describes a first part of the attachment procedure. Then, to complete the attachment procedure, the following steps need to be taken:

The coupler 10 and partially attached accessory 20 is then curled together into the crowd position by rotating the coupler such that the front jaw 24 is initially drawn towards the cab of the excavator, and then up and in towards the underside of the excavator arm. Once in the crowd position, the coupler 10 will be at least partially inverted, as shown in FIGS. 8 and 9, whereupon the first latching mechanism will fall under the influence of gravity into its open position—as shown in FIG. 8. Likewise the blocking mechanism 78 for the hook 54 will have fallen under the influence of gravity into its non blocking position, as shown in FIG. 9, as a result of which the hook 54 can be pulled into its open position by the hydraulic ram 62 (the final position for the hook 54 is shown in FIG. 9, but the hydraulic ram, shown in FIGS. 1 and 2, is not shown in FIGS. 8 and 9 for reasons of image clarity).

Once that hook 54 has been moved into that open position, which is only possible while the blocking mechanism 78 is not bearing against the stepped flanges 84 at the rear of the hook 54, the second attachment pin 22 will have dropped into the rear jaw 26, as shown in FIG. 9. The hydraulic ram 62 can then drive the hook 54 back out to close the jaw for securing the second attachment pin in that rear jaw 26. The accessory is thus fully secured to the coupler, and upon reinverting the coupler to its upright position, the first latching mechanism will once again fall into its jaw-closing position, and the blocking mechanism will fall behind the hook 54 for blocking it from releasing the second attachment pin 22, even accidentally. The coupler is thus secured and made safe on the coupler 10.

FIG. 3 shows an alternative, and preferred condition to put the coupler 10 into before commencing an attachment procedure. It is preferred since it is the condition that will automatically be arrived at immediately after completing an accessory detachment procedure, whereby it will not need to be achieved by a separate step.

As can be seen from FIG. 3, the free end 42 of the arm 40 is hung up on the rear surface 58 of the second latching mechanism 38 on a flange 74 extending outwardly of the hook 54. In that configuration, an attachment pin 22 can be easily passed in and out of the front jaw 24. This is therefore the default condition for commencing an attachment procedure. Therefore, from this condition, the coupler is manipulated with the excavator arm so as to engage a first attachment pin 22 into the front jaw 24. Then the excavator arm is powered to lower the rear of the coupler onto the second attachment pin so as to engage that second attachment pin within the rear jaw 26. The rear hook is then powered with the hydraulic ram to close the rear jaw for latching the hook 54 onto the second attachment pin. The coupling procedure is thus completed.

The first latching mechanism and the blocking mechanism will have dropped into their jaw-closing and blocking positions respectively, as the hook was powered into its closed position, so the coupler is even more quickly made safe when following this simple procedure.

An important detail is the point at which the free end 42 of the arm 40 falls off the flange 74 at the rear of the hook 54, as the hook 54 is powered into its closed position. That position is known as the minimum safe pin spacing position, and it is shown as being passed in the transition from FIG. 5 to FIG. 6. It is the point at which the free end 42 clears the flange 74, whereupon it is free to drop, as per arrow 76, into the front jaw closing position of FIG. 6. With the hook in that position, the minimum safe pin spacing for an accessory can be determined, and it is determined as being the smallest accessory pin spacing that can be attached to the coupler while the hook is in that position. Preferably the rear jaw is positioned relative to the front jaw 24 so as to pre-indicate that minimum pin spacing by not allowing a smaller pin spacing to be accommodated. For an example of that, see FIG. 4, where the rear jaw's front lip 75 can be seen to be in approximate registration with the free end of the hook 54.

The hook, as it passes that point, then starts (or continues) to move across the opening 34 of the rear jaw 26, whereupon it will eventually engage against the second attachment pin 22 for completing the locking procedure.

The minimum pin spacing position can be accurately set by adjusting the position and shape of the flange 74 on the hook 54, and/or by adjusting the length of the arm 42. It is set such that the free end 42 of the arm will always fall off the flange 74 before an attachment pin is secured within the rear jaw 26 of the coupler 10. This is to remove the possibility of using the coupler for securing an accessory that would allow the use of the first latching mechanism 36 to be bypassed.

Figure 7:
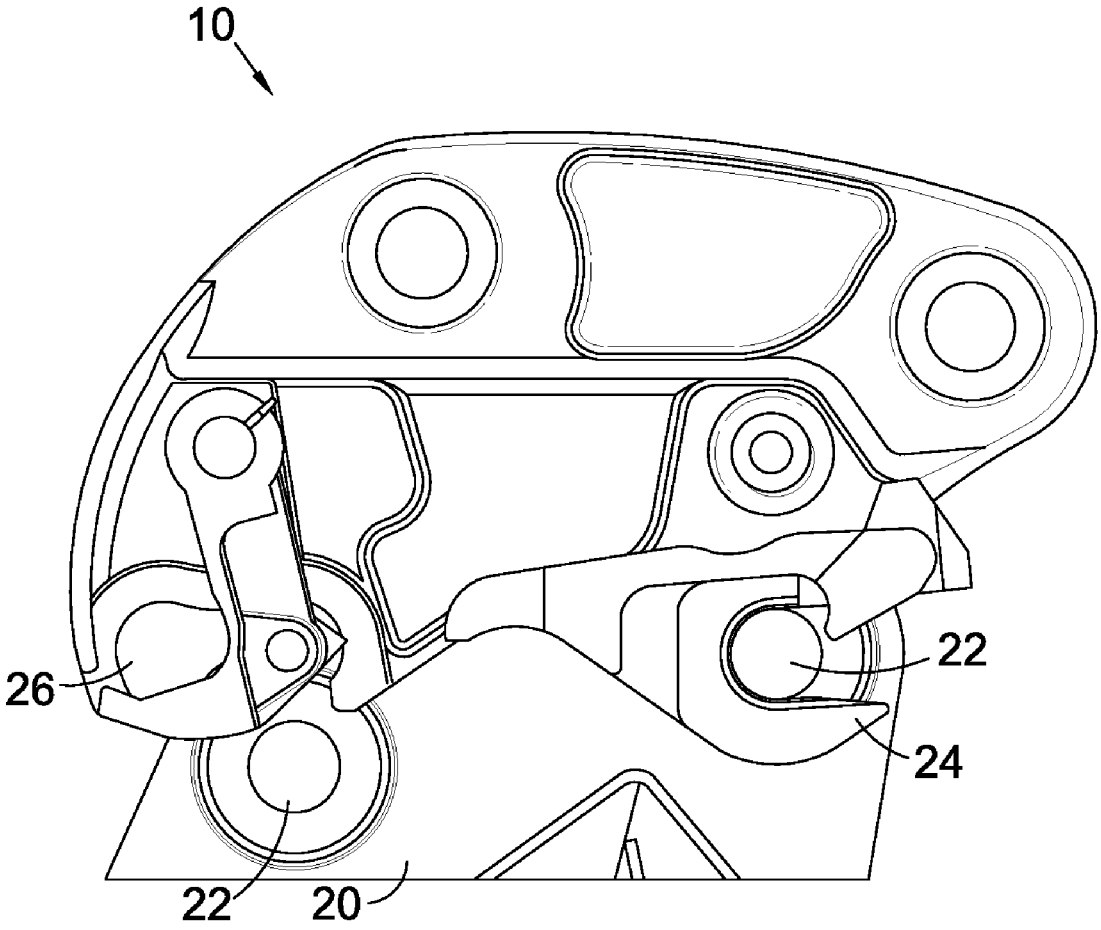
FIG. 7 shows the front latch in its jaw-closing position for capturing a first attachment pin of an accessory, but with the second attachment pin of the accessory being accidentally not latched by the second latch.

A significant benefit of this improved coupler will now be described with reference to FIG. 7. That figure illustrates an incorrectly attached accessory 20—the second attachment pin 22 has been missed by the latch of the rear jaw 26. Therefore, even though the rear jaw 26 has been closed by the hook 54, the jaw does not retain that second attachment pin 22. Therefore, the accessory 20 is only secured onto the coupler 10 by the front jaw. However, has the coupler not featured a front latching mechanism, such a coupling condition would be extremely dangerous since the accessory 20 would be free to fall out of the front jaw 24 upon rotating the coupler clockwise (relative to that view)—it is not always obvious to a driver of an excavator, from his position in the cab, when an accessory is incorrectly mounted. Therefore that first clockwise movement might only occur after the accessory has been lifted off the ground and swung sideways, i.e. away from its initial safe position. Therefore, with some old designs, there can be a risk of dangerous situations arising following user error. However, because the present invention has the first latching mechanism 36 associated with the front jaw 24, and since that front jaw 24 is thereby automatically in a latched condition even despite the user error, the attachment pin 22 in the front jaw 24 cannot drop out of the front jaw 24. Therefore, the failed engagement of the second attachment 22 into the rear jaw 26 has not resulted in a dangerous condition arising, and the operator of the excavator, when he finally does recognise the improper mounting state of the accessory, can then address that situation by recoupling the accessory 20 onto the coupler 10 in the proper manner (e.g. by following the remaining steps of the first method discussed above).

As mentioned in brief in the discussion above, the present invention additionally has a blocking mechanism for the rear hook 54. That blocking mechanism 78 takes the form, in this example, of a blocking bar 78. See FIG. 4 for a clear illustration of the blocking bar 78.

Figure 4:
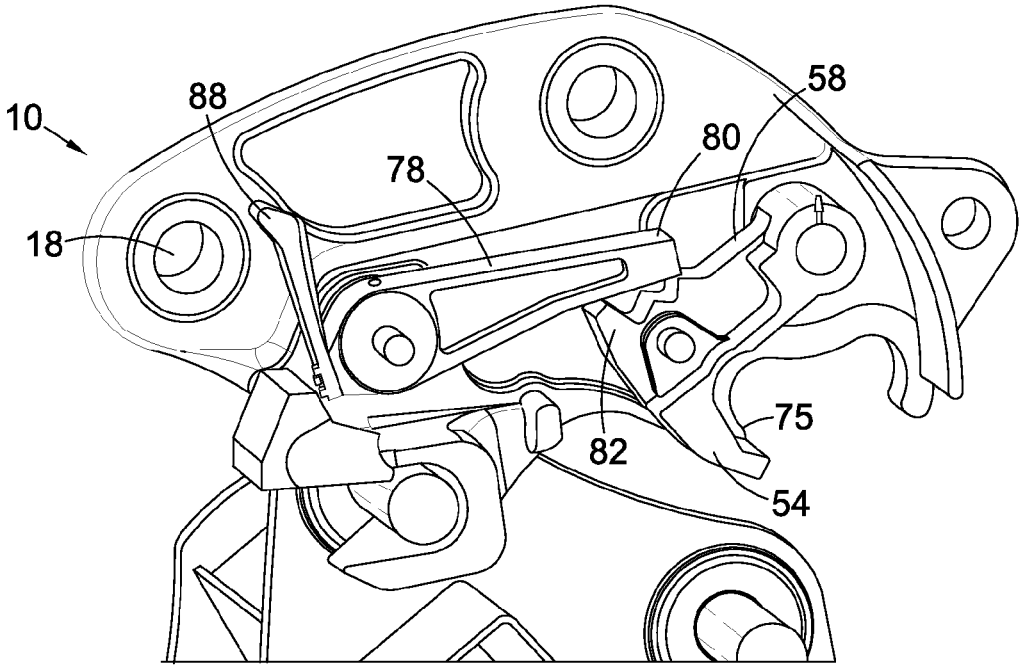

The blocking bar 78 is shown in FIG. 4 in a non-blocking position. It is "non-blocking" since its free end 80 is not resistibly bearing against the rear surface 58 of the hook 54. Instead it is just sitting on a rear flange 82 of the hook 54.

Referring next to FIG. 2, however, the blocking bar 78 has now been dropped into a blocking position behind the hook, on a further flange or step 83 of the hook 54. That further flange or step 83 holds the blocking bar 78 so that it can bear against a riser surface 84 should the hook attempt to retract away from the rear jaw 26 towards an open position. Further, that step 83 is one of two steps that are provided on the rear surface 58 of the hook 54. This is to allow multiple different blocking states to be achieved, each one being more suitable for a different set range of pin spacings for the accessory.

The blocking bar 78 is mounted along an opposite side of the coupler 10 to the arm 40 of the first latching mechanism 36. Because of that it will bear against the rear surface 58 of the hook 54 at a different position—on an opposite side of the hook 54. Those two sides of the rear of the hook can therefore have completely different configurations. This complex shape for the hook can be achieved by moulding the hook with a bifurcated section—one prong of that section carries the steps 83 and riser surfaces 84, and the other carries the flange 74 for the free end 42 of the arm 40 to sit upon. The hinge pin 66 for the hook can then extend through both sides of the hook 54, with the space between the sides allowing for the free end of the rod of the ram to pivot relative to the hook 54.

The blocking bar 78 can be mounted to the frame 12 of the coupler 10 about the same hinge pin as the head 64 of the ram 62. Alternatively it might be provided with a separate hinge axis, via a separate mounting to the frame 12.

Figure 12:
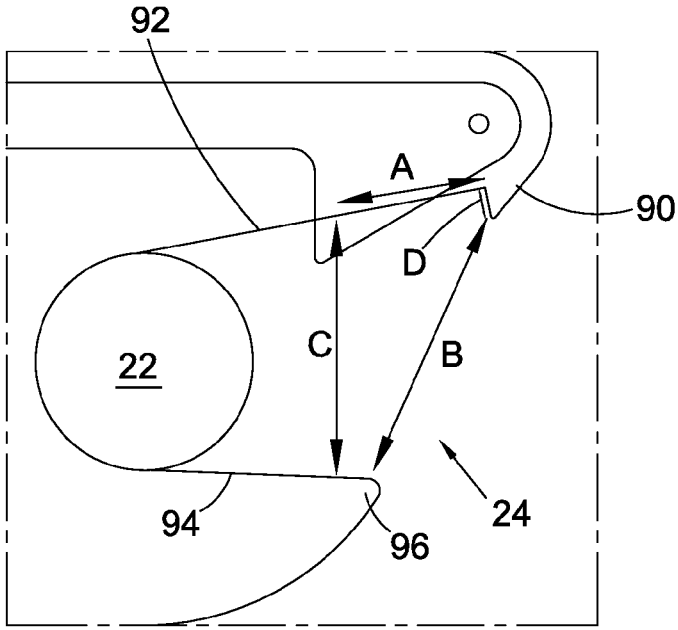
FIG. 12 shows in greater detail the jaw from FIG. 11.

The illustrated blocking bar 78 is gravity operated, whereby in the normal configuration as shown in FIG. 12, it is biased into its downward position by virtue of gravity acting on the arm of the blocking bar 78. However, upon inverting the coupler, for example to the position shown in FIG. 9, the blocking bar 78 will have fallen downwardly, as per the arrow 86 in FIG. 9, into its non-blocking position.

Only once the blocking bar has moved into a non blocking position can the rear hook 54 be powered into its open position, e.g. for releasing a pin 22 from the rear jaw 26, or for locating one in the rear jaw.

When the hook 54 is in that open position, the flange 74 on the rear of the hook 54 will hold the blocking bar 78 in its non-blocking position such that the coupler 10 can be returned to its normal upright condition as shown in FIG. 4.

From the above it will be appreciated that both the first latching mechanism 36 and the blocking bar 78 operate roughly in unison, and under the same gravitational influences, when moving into their open or unblocking positions upon inverting the coupler. Likewise they can both be held in those "lifted" positions by their respective parts of the rear surface 58 of the hook 54, as shown in FIGS. 3 and 4, even after reverting the coupler to its upright condition. Further, they can both be released into their jaw-closing and blocking positions upon powering the hook 54 into a pin-latching position.

In this illustrated embodiment, no biasing means other than gravity is needed to operate the first latching mechanism 36 and the blocking bar 78. However, it is preferred that at least one of the first latching mechanism and the blocking bar 78, and more preferably just the blocking bar, are provided with some form of biasing mechanism to hold it or them in a latching or blocking position whenever the coupler is in a conventional operating orientation with respect to the end of the excavator arm, i.e. in positions other than the crowd position discussed above.

One such biasing means for that purpose is a spring arm 88, as provided for the blocking bar 78. See FIGS. 2 and 4. That spring arm 88 points from a rear of the blocking bar 78 towards and into the top half 12 of the coupler, and it is located to extend or pass close to a front attachment hole 18 of the coupler, as used for attaching the coupler to one of the elements of the excavator arm. That front attachment hole is provided in the top half 14 of the coupler 10, as also shown in FIG. 4.

That spring arm 88 is adapted to bear against that part of the excavator arm that accommodates the front attachment pin of the excavator arm. It will not usually bear against any component of the frame of the coupler 10. Its design is such that, when the coupler is rotated away from the cab into an inverted position, i.e. not into a crowd position, that spring will bear against that part of the arm of the excavator to hold the blocking bar 78 in its blocking position, even though the coupler 10 may be inverted in that direction. This maintains a secured attachment for the coupler throughout all normal use conditions.

However, upon rotating the coupler 10 into the crowd position, i.e. in the direction initially towards the cab, that spring arm 88 will move away from that part of the excavator arm, thereby allowing the blocking bar 78 to fall into its "raised" position upon that inversion. (The crowd position is the position that the coupler 10 will reach upon curling it fully towards the driver, and then under the arm, with the arm bent towards the driver.)

Therefore, with this improved arrangement, only upon placing the coupler, and, where present, accessory, into the crowd position, can both the blocking bar 78 and the first latching mechanism 36 be moved into the non-blocking/open positions, e.g. for commencing a preferred accessory attachment procedure, or an accessory release procedure.

In a preferred embodiment, the hydraulic ram is fitted with a check valve to ensure that even upon a hydraulic fluid delivery pipe failure, pressure loss will not occur within the hydraulic ram. This is to ensure that the hook 54 will maintain a locked position in such circumstances.

Further, the leading surface 68 of the first latching mechanism 36 can be painted in a distinctive or contrasting colour to allow it to function more readily as a visual aid for the operator—it is usually visible from the operator's cab. Being able to see it allows the operator to verify that the first latching mechanism 36 has properly engaged a pin 22 within the front jaw 24.

Finally, a preferred method of decoupling an accessory from the coupler 10 will now be described. Whereas a preferred sequence of attachment is illustrated by reference, in sequence, to FIGS. 3&4, and then FIG. 5 and then FIG. 6, which then arrives at the condition of FIGS. 1&2, the preferred sequence of detachment is illustrated by reference, in sequence, to FIGS. 1&2, and then FIGS. 8&9, and then FIGS. 3&4 and then FIG. 10. Therefore, starting with FIGS. 1&2, an accessory 20 is shown correctly and securely mounted onto the coupler 10. Then, to commence the decoupling procedure, the coupler and accessory are rotated under the arm and towards the operator in the cab, into the crowd position. Once in that position, the blocking bar 78 and the first latching mechanism will have fallen into their "raised" positions—see arrows 49 and 86. Therefore, the front jaw 24 will be open, and the rear hook 54 will be openable.

Then, the hook 54 is powered into its open position. This open and inverted condition is as illustrated in FIGS. 8&9. The front jaw 24 is shown to be pointing slightly uphill in this position. This is to ensure that the weight of the accessory maintains the engagement of the first attachment pin 22 within the front jaw 24 and the second attachment pin 22 in the rear jaw.

The next step is then to uncurl the coupler and accessory, and to lower the excavator arm, to lower the accessory 20 into contact with the ground. This then makes the arrangement safe, once the accessory is in a stable orientation with respect to the ground. At that point the non-secured attachment pins can be peeled out of the jaws 24, 26, one at a time, commencing with the rear jaw 26, as per FIGS. 3&4, and then finally with the front jaw 24, as in FIG. 10. The decoupling procedure is thus finished, leaving the coupler 10 in a condition ready to receive its next accessory 20.

Figure 11:
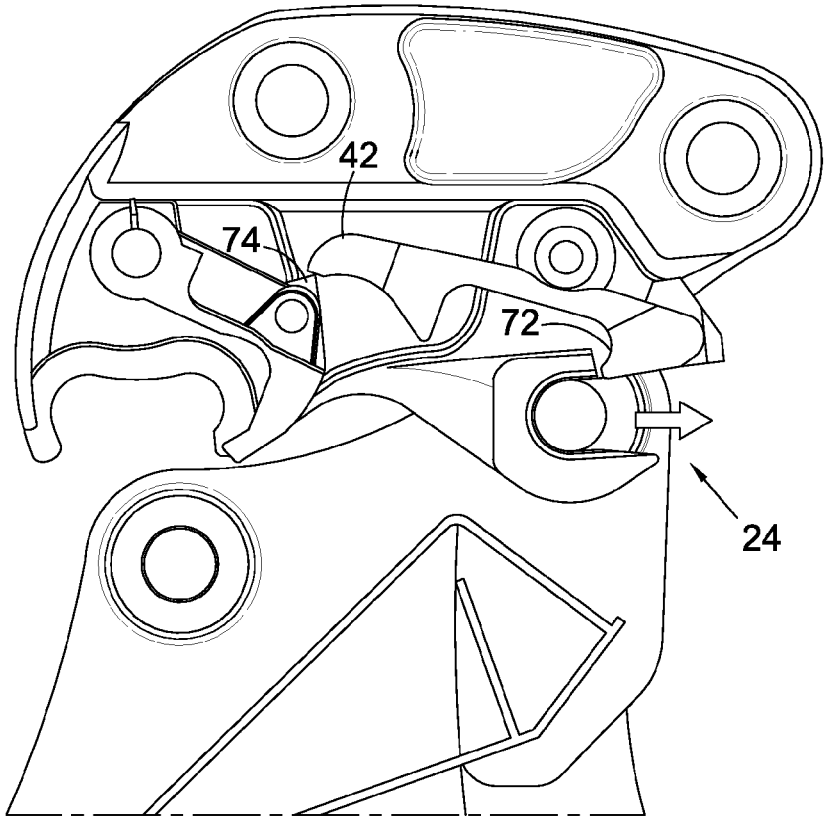
FIG. 11 shows a view corresponding to FIG. 10 of a coupler with a modified front jaw.

Referring next to FIGS. 11 and 12, a small adaptation of the coupler, as previously described, is shown. The coupler's front jaw 24 has a ridge or lip 90 provided in the upper wall 92 of its profile, the ridge or lip 90 extending downwardly. In preferred embodiments, the lip 90 extends partially across the opening of the jaw 24. For jaws for accommodating attachment pins having a diameter of perhaps up to 80 mm, preferably it extends D across the opening by between 5 and 8 mm. However, in most applications it is preferred that it extends D no more than a fifth of the way across the opening. The illustrated dimension D in FIG. 12 can be said to be the height of the lip or ridge 90.

The illustrated upper wall 92 of the front jaw's profile extends further forwards, relative to the frame of the coupler 10, than the lower wall 94 of that profile. This enables it to overhang the lower profile. The lip or ridge 90 is located in the overhanging area of that upper wall, clear of the lower wall. Its overhang increases the relative gap between the bottom of the ridge or lip 90 and the free end 96 of the lower wall 94. Indeed, the increase is such that the gap has a length B that is in excess of the distance C between that lower wall 94 and the upper wall 92 when measured diametrically across the jaw 24 at that tip 96. This is to ensure that the attachment pin 22 can be readily inserted into or out of the jaw 24. The lip, however, provides a resistance to such removals whenever the coupler 10 is inverted. This is useful since the front jaw will be open when the coupler is inverted, whereby the lip 24 can offer a simple resistance to accessory drop-off in that situation. This is particularly useful where the rear jaw 26 is a significantly wider jaw than the height C of the front jaw. That is because in situations where a wide attachment pin spacing on the accessory is being accommodated, such accessories can be caused to slide within the jaws by an excessive inversion of the coupler 10. In that situation, the lip can help to resist that sliding for preventing the front attachment pin from exiting the front jaw 24.

That diametric measurement C might also be referred to as an approximately perpendicular height of the mouth or opening of the jaw 24. The upper and lower walls 92, 94, however, are not usually parallel to one another—a widening mouth facilitates attachment pin location into the jaw 24. Therefore, "perpendicular" would then be being used in a rather loose manner.

Figure 13:
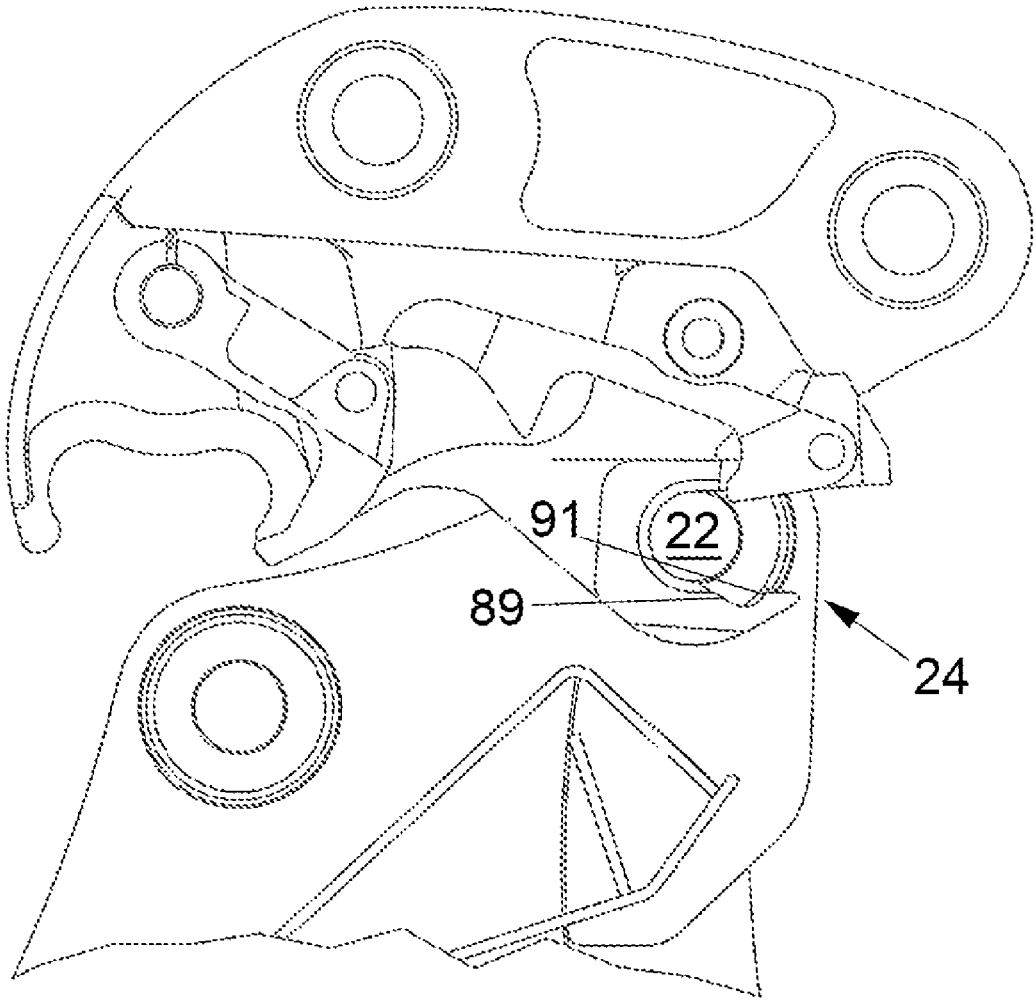
FIG. 13 shows a further view corresponding to FIG. 10 of a coupler with another modified front jaw.

Referring finally to FIG. 13, a further variant is disclosed. In this variant, the lower wall of the front jaw has a dip or groove 89 provided in it, extending downwardly. The dip or groove is part ramped—towards the back of the jaw, and part radiused—for providing an outer lip 91 against which the attachment pin 22 can hit, for stopping further exiting of the pin 22 from the jaw 24, in the event of the attachment pin 22 starting to slip out of the front jaw 24. The radius is optional and it certainly does not need to match the radius of the attachment pin.

The dip or groove 89 serves to catch and hold an attachment pin of an accessory in the event of an improper mounting of an accessory to the coupler—due to the weight of the accessory, a free hanging accessory in that dip or groove will not easily be shaken out of that dip or groove. This therefore gives an operator even further time to notice that there has been an improper mounting of the accessory to the coupler.

The best effect can be noted when the dip or groove's depth is between 0.3× and 0.1× the diametric height of the jaw (which diametric height is only perhaps 10% bigger than the diameter of the pin 22).

Of course, the ridge or lip 90 of FIG. 11 might be combined with the dip or groove 89 of FIG. 13 to provide an even further modified coupler.

Figure 14:
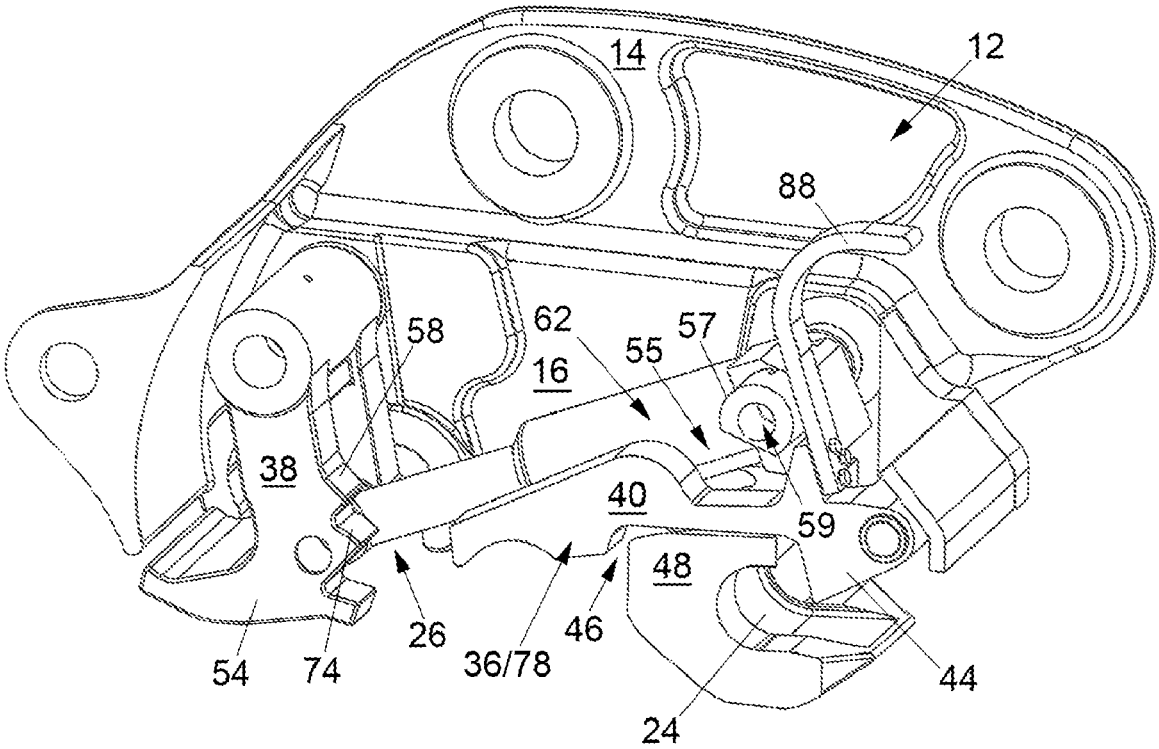
FIGS. 14 to 16 show an alternative arrangement for a coupler of the invention.
Figure 15:
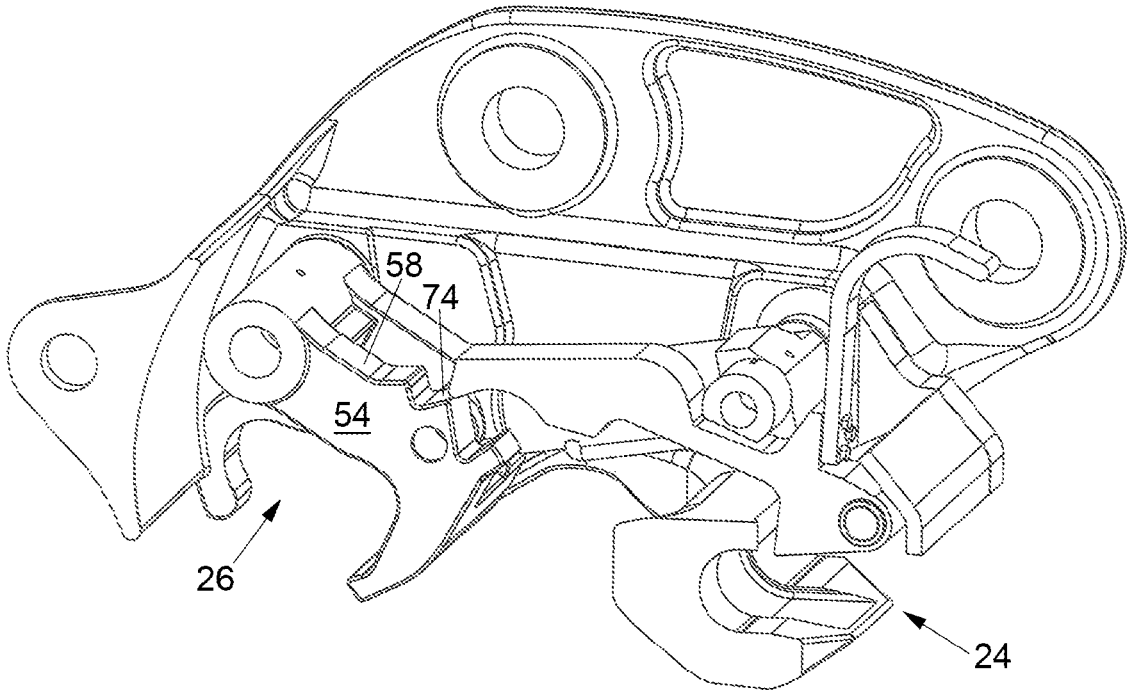
Figure 16:
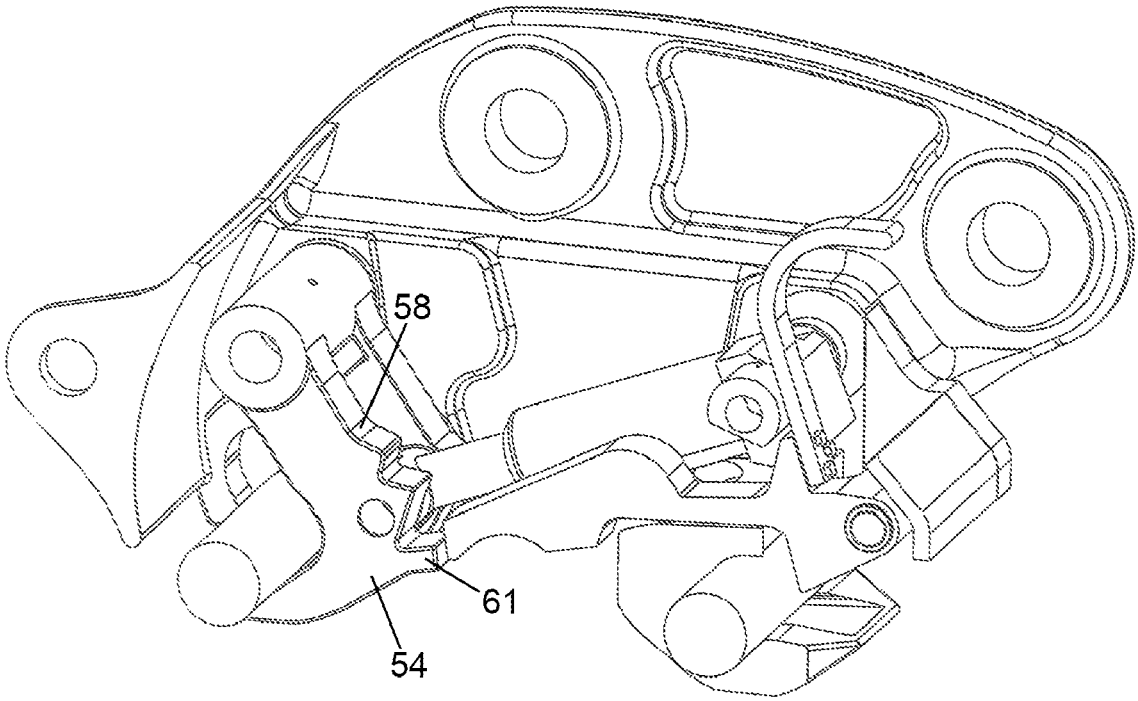

Referring next to FIGS. 14 to 16, a further embodiment of coupler 10 is illustrated. It has many corresponding features to the earlier embodiments, such as a frame 12 with a top half 14, a bottom half 16, a front jaw 24, a rear jaw 26, a front latching mechanism 36 with a finger or block 44 for closing the front jaw 24 and a rear latching mechanism 38 in the form of a pivoting latching hook 54 for closing the rear jaw 26, a hydraulic ram 62 for operating the rear latching mechanism 38 and a blocking bar 78. However, instead of the blocking bar 78 being a separate component to the front latching mechanism 36, they are made from one and the same member.

Compared to the earlier embodiments, the arm 40 of the front latching mechanism 36 still overlies the structure 48 of the front jaw 24 by having a cut-out area 46. Likewise it has an upper cut-out area 55 for accommodating a bearing member 57 for the front pivot pin 59 of the hydraulic ram 62. That bearing member, however, has a flattened surface that faces that upper cut-out area. The upper cut-out area and the flat surface together permit a greater degree of rotation for the front latching mechanism. Further, the arm 40 is longer than in the earlier embodiment, such that its end can provide a blocking function for resisting movement of the hook 54 into an open position. See FIG. 16. As shown in that figure, a flange 61 of the hook will bear against the free end of the arm 40 if the hook 54 is moved from a latching position towards a non-latching position. The front latching mechanism 36 therefore doubles as a blocking bar 78 for the rear latching mechanism 38.

In this illustrated embodiment, the rear surface 58 of the hook 54 has a second flange, or a step 74. That flange 74, like the flange 74 of the earlier embodiment serves to hold the first latching mechanism in its open position once the coupler 10 has been inverted and the hook then retracted.

As for the spring member 88 for the first latching member 36, it is bolted onto an upstanding flange of the arm 40. It has a curved end to define an inverted "J" shape. The base of the J selectively bears against the excavator arm of the excavator until the coupler 10 and excavator arm (not shown) are moved into the crowd position. In that position, as with the earlier embodiment, the first latching mechanism is no longer biased into or towards its latching position for the front jaw, whereupon it can fall into an open position under the influence of gravity thereon.

The coupler 10 of this last embodiment, therefore, operates with substantially identical procedures as the first embodiment, albeit with only one gravity-movable member. That member, after all, serves the dual functions of the two gravity-operated members of the earlier embodiment.

Couplers of the present invention, and their preferred modes of use, have therefore been described above purely by way of examples. Modifications in detail, however, can be made to the invention within the scope of the claims appended hereto.

The invention claimed is:

1. A coupler having a top half for attaching to an end of an excavator arm of an excavator and a bottom half for attaching to an accessory; wherein:

the bottom half comprises:

a first jaw having an opening pointing generally towards the front end of the coupler and a second jaw having an opening pointing generally downwards with respect to the coupler;

a first latching mechanism associated with the first jaw; and a second latching mechanism associated with the second jaw, the second latching mechanism being powered for movement between an open position and a closed position, wherein the first latching mechanism has an arm extending therefrom and towards the second latching mechanism, whereby the second latching mechanism can hold the first latching mechanism in an open position when it is in its own open position; and the coupler further comprising:

a blocking mechanism that is independent of the first latching mechanism, and being for selectively blocking the second latching mechanism in its latching position, the blocking mechanism being operable between a blocking position and an unblocking position by a separate drive means, or by the influence of gravity, operation by the influence of gravity comprising attaining a blocking position when the top side of the coupler is pointing generally upwards and an unblocking position when the bottom side of the coupler is pointing generally upwards.

2. The coupler of claim 1, wherein the first latching mechanism comprises a finger or block that extends in a different direction to the arm, and which provides an at least partial blockage of the opening of the first jaw when the first latching mechanism is in a jaw-closing position.

3. The coupler of claim 1, wherein the arm of the first latching mechanism extends down one side of an internal space of the coupler.

4. The coupler of claim 1, wherein the blocking mechanism comprises a member that extends down one side of an internal space of the coupler.

5. The coupler of claim 1, wherein the arm of the first latching mechanism extends down one side of an internal space of the coupler and the blocking mechanism comprises a member that extends down one side of the internal space of the coupler, the arm and member extending down different sides of the internal space of the coupler.

6. The coupler of claim 1, wherein an second latching member is powered by a hydraulic ram that is located down the centre of the internal space of the coupler.

7. The coupler of claim 1, wherein the blocking mechanism shares a common pivotal axis with the second latching mechanism's actuator.

8. The coupler of claim 1, wherein the first latching mechanism is defined by a first pivotal latch.

9. The coupler of claim 1, wherein the second latching mechanism is defined by a second pivotal latch.

10. The coupler of claim 1, wherein a latching member of the first latching mechanism extends into the jaw, and has a greater width than the arm of the first latching mechanism.

11. The coupler of claim 10, wherein the width of the latching member is at least approximately a third of the width of the front jaw.

12. The coupler of claim 1, wherein a part of the first latching mechanism is visible in the jaw when the first latching mechanism is in a jaw-closing position, and the part is painted in a high-visibility colour, or in a contrasting colour to the jaw, for making it more readily visible from the cab of the excavator through the opening of the jaw.

13. The coupler of claim 1, wherein a free end of the excavator arm has an increased lateral width relative to the rest of the arm to provide a greater mass at the free end.

14. The coupler of claim 1, wherein the blocking member has a width that generally corresponds to the width of one of the arm and the free end of the arm.

15. The coupler of claim 1, wherein the second latching mechanism comprises a pivoting latching hook.

16. The coupler of claim 15, wherein a rear surface of the latching hook has steps provided thereon for providing adjustability for the blocking mechanism, whereby a plurality of different accessories, each with different pin spacings, can be accommodated by the coupler.

17. The coupler of claim 16, wherein the steps on the rear surface of the hook are down just one flank of that surface of the hook, the hook may have two such flanks, with the other flank being adapted for selectively engaging the first latching mechanism.

18. The coupler of claim 1, wherein the arm of the first latching mechanism has a cut-out in its underside for accommodating the structure of the front jaw and an attachment pin of an accessory, whereby that cut-out can rest against the top of the structure of the front jaw when the first latching mechanism is in a jaw-closing position.

19. The coupler of claim 1, wherein the arm has an indentation in a top wall thereof for engaging a member of the frame of the coupler.

20. The coupler of claim 1, wherein the first latching mechanism has a face that is adapted to face towards an attachment pin of an accessory, when the accessory pin is located fully within the front jaw, that surface extending generally downwardly into the jaw to a point at least one-third of the way across the opening.

21. The coupler of claim 1, wherein a hinge axis of the first latching member is located above the line of the reaction force between an attachment pin of an accessory and the pin facing/engaging surface of the latching member in the event of an attempted removal of the pin from the front jaw, once the first latching mechanism is in its jaw-closing position.

22. An excavator fitted with a coupler according to claim 1.

23. The coupler of claim 1, wherein the front jaw has a ridge or lip provided in an upper wall of its profile, wherein the upper wall of the front jaw's profile extends further forwards, relative to the frame of the coupler, than the lower wall of that profile so as to overhang the lower profile, wherein the lip or ridge is located in the overhanging area of that upper wall, and wherein the gap between the bottom of the ridge or lip and the free end of the lower wall of the profile of the front jaw has a length that is no less than the distance between that lower wall and that upper wall when instead measured diametrically therebetween.

24. A coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position, wherein the powered latch, in its non-latching position, can maintain both the blocking mechanism in its non blocking position and the other latch in its non-latching position, irrespective of the orientation of the coupler.

25. The coupler of claim 24, wherein the blocking mechanism is spring biased towards a blocking position by a spring member that is adapted to engage against a portion of an excavator arm during certain normal conditions of use, but not in the crowd position.

26. The coupler of claim 24, wherein a front one of the jaws has one of a ridge and lip, and/or one of a dip and groove, provided in an upper wall of its profile.

27. The coupler of claim 26, wherein the upper wall of the front jaw's profile extends further forwards, relative to the frame of the coupler, than the lower wall of that profile so as to overhang the lower profile.

28. The coupler of claim 27, wherein the lip or ridge, and/or dip or groove, is located in the overhanging area of that upper wall.

29. The coupler of claim 28, wherein the lip or ridge, and/or dip or groove, is a lip or ridge, and the gap between the bottom of the ridge or lip and a free end of the lower wall of the profile of the front jaw has a length that is no less than the distance between that lower wall and that upper wall when measured diametrically therebetween.

30. The coupler of claim 24, wherein the front jaw has one of a ridge and a lip, and/or one of a dip and a groove, provided in a lower wall of its profile.

31. The coupler of claim 30, wherein ridge or lip, and/or a dip or groove provides an outer lip against which the attachment pin can hit, for stopping further exiting of the pin from the jaw, in the event of the attachment pin starting to slip out of the front jaw.

32. The coupler of claim 31, wherein the ridge or lip, and/or a dip or groove is a dip or groove, and its depth is between 0.3× and 0.1× the diametric height of the jaw.

33. An excavator fitted with a coupler according to claim 24.

34. The coupler of claim 24, wherein the blocking mechanism is gravity operated.

35. The coupler of claim 24, wherein the opening of a downwardly facing one of said jaws has a height—measured in the longitudinal direction of the coupler—of at least 1.5× the height—measured in the height direction of the coupler—of the opening of the other jaw.

36. A method of coupling an accessory to a coupler, the method comprising:

a) providing an excavator with a powered excavator arm having a coupler on an end thereof, the coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position;

b) opening the jaw with the powered latch;

c) providing an accessory with two attachment pins thereon sized and spaced to fit into the two jaws of the coupler;

d) powering the excavator arm to manipulate the coupler to locate a first attachment pin of the accessory into the jaw associated with the other latch;

e) powering the excavator arm to curl the coupler relative to the accessory to locate the second attachment pin into the opened jaw; and f) powering the powered latch to engage the powered latch against the second attachment pin to secure it within that now closed jaw.

37. The method of claim 36, wherein the powered latch is powered in step b) while the coupler is at least partially inverted, the blocking mechanism and other latch being gravity operated such that they move to non blocking and open positions, respectively, as the coupler is moved into that at least partially inverted orientation.

38. A method of decoupling an accessory from a coupler, the method comprising:

a) providing an excavator with a powered excavator arm having a coupler on an end thereof, the coupler comprising two jaws and a latch for each jaw, one of the latches being powered for movement between a latching position and a non-latching position, and being associated with a blocking mechanism that is remotely movable between a blocking position and non blocking position, and the other latch being independent of the blocking mechanism, but being also remotely moveable between a latching position and a non-latching position;

b) providing an accessory with two attachment pins thereon fitted into the two jaws of the coupler;

c) rotating the coupler and accessory into a crowd position for at least partially inverting the coupler;

d) opening the jaw having the powered latch;

e) powering the excavator arm to manipulate the coupler back from its crowd position to position the accessory on hard standing, such as the ground; and continuing to power the excavator arm to guide the coupler off the accessory, the two latches now being open.

39. A coupler for attaching an excavator arm and an accessory, comprising:

a first jaw having an opening pointing generally towards the front end of the coupler;

a second jaw having an opening pointing generally downwards with respect to the coupler;

a first latching mechanism associated with the first jaw;

a second latching mechanism associated with the second jaw, the second latching mechanism being selectively moveable between an open position and a closed position; and a blocking mechanism separate from the first latching mechanism and movable between a blocking position preventing the second latching mechanism from moving from its closed position and a non-blocking position permitting the second latching mechanism to move between the closed and open positions.

40. The coupler of claim 39, wherein the first latching mechanism pivots about a first pivot point and the blocking mechanism pivots about a second pivot point, different from the first pivot point.

41. The coupler of claim 39 wherein gravity moves the blocking mechanism from the blocking position to the non-blocking position.

42. The coupler of claim 41, wherein when a top side of the coupler is pointing generally upwards, the blocking mechanism moves to the blocking position and wherein when a bottom side of the coupler is pointing generally upwards, the blocking mechanism moves to the non-blocking position.

* * * * *